United States Patent [19]

Castagnos, Jr. et al.

[11] 4,430,201

[45] Feb. 7, 1984

[54] REGENERATION OF FLUIDIZABLE CATALYST

[75] Inventors: Leonce F. Castagnos, Jr., Nederland; Roy E. Pratt, Neches, both of Tex.

[73] Assignee: Texaco, Inc., White Plains, N.Y.

[21] Appl. No.: 315,470

[22] Filed: Oct. 27, 1981

[51] Int. Cl.[3] ..... C10G 11/18

[52] U.S. Cl. ..... 208/164; 502/43

[58] Field of Search ..... 208/164, 118; 252/416, 252/417, 419; 422/144

[56] References Cited

U.S. PATENT DOCUMENTS

| | | | |
|---|---|---|---|
| 3,926,778 | 12/1975 | Owen et al. | 252/417 X |
| 3,970,587 | 7/1976 | Shinnar et al. | 252/417 |
| 4,035,284 | 7/1977 | Gross et al. | 208/164 X |
| 4,093,537 | 6/1978 | Gross et al. | 208/164 |
| 4,116,814 | 9/1978 | Zahner | 208/164 X |
| 4,211,636 | 7/1980 | Gross et al. | 208/164 |
| 4,272,402 | 6/1981 | Mayes | 252/417 |
| 4,283,273 | 8/1981 | Owen | 208/164 X |
| 4,324,688 | 4/1982 | Castagnos, Jr. et al. | 208/164 X |

*Primary Examiner*—Delbert E. Gantz
*Assistant Examiner*—Glenn A. Caldarola
*Attorney, Agent, or Firm*—Carl G. Ries; James F. Young; Robert Knox, Jr.

[57] ABSTRACT

A method and apparatus for regeneration of coked catalyst resulting from a hydrocarbon conversion reaction in which catalyst regeneration is carried out in a plurality of superposed regeneration zones comprising the combination of a first dense phase fluidized bed regeneration zone, an entrained catalyst dilute phase regeneration zone superposed on said first regeneration zone, and a second dense phase fluid bed regeneration zone superposed on said dilute phase regeneration zone. Catalyst is regenerated by combustion of coke from the surface of the catalyst at an elevated temperature in the range of 675° to 800° C. with an excess of oxygen supplied by an oxygen-containing regeneration gas part of which is introduced into the first fluidized bed regeneration zone and part into said dilute phase regeneration zone, including a novel means of control of the rate of catalyst recirculated from said second dense phase regeneration zone to said first regeneration zone.

2 Claims, 1 Drawing Figure

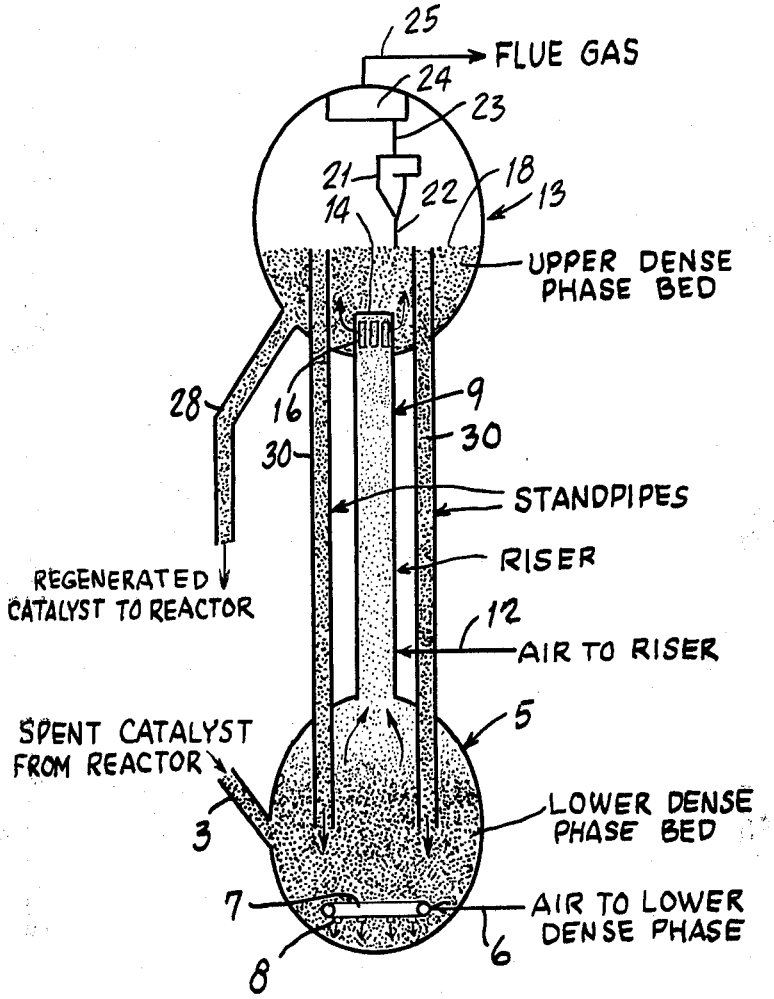
25
FLUE GAS
24
23
21
22
18
13
14
UPPER DENSE PHASE BED
28
16
9
30
30
STANDPIPES
RISER
REGENERATED CATALYST TO REACTOR
12
AIR TO RISER
5
SPENT CATALYST FROM REACTOR
3
LOWER DENSE PHASE BED
7
AIR TO LOWER DENSE PHASE
6
8

REGENERATION OF FLUIDIZABLE CATALYST

This invention relates to a method and apparatus useful in hydrocarbon conversion processes employing fluidized particulate catalysts wherein the catalyst is regenerated by burning coke from its surface by means of an oxygen-containing gas. In one of its more specific aspects, this invention relates to an improved method of and apparatus for regeneration of spent cracking catalysts. In another of its more specific aspects, this invention relates to an apparatus for regeneration of spent cracking catalyst at high temperature with substantially complete combustion of coke and wherein regeneration may be carried out at a temperature in the range of 675° to 800° C. with substantially complete elimination of carbon monoxide from the regeneration flue gases.

Fluidized catalytic cracking processes for the conversion of petroleum fractions are well known. In such fluidized catalytic cracking processes, a hydrocarbon oil feedstock is contacted with a catalyst in a reaction zone under conditions such that the conversion of the hydrocarbon feedstock into desired products is accompanied by the deposition of coke on the surface of the catalyst particles. Such systems may comprise a dense phase fluidized bed of catalyst in a partially filled vessel or a tubular transport type reaction zone through which vaporized hydrocarbons and solid particulate catalyst suspended in the hydrocarbon vapors are passed concurrently, or both. In the latter, the reaction products and catalyst are discharged from the tubular transport type reaction zone into a separation zone in which hydrocarbon are separated from the catalyst. During its tenure in the reaction zone, the catalyst becomes partially deactivated due to the deposition of coke thereon and is often referred to as "spent" catalyst as contrasted with regenerated or fresh catalyst. Fresh catalyst and regenerated catalyst have a lower coke content and higher catalytic activity than the spent catalyst removed from the reaction zone.

In the regeneration of hydrocarbon conversion catalysts, spent catalyst from the reaction zone may be contacted in a stripping zone with a stripping medium, usually steam, to remove vaporizable entrained and occluded hydrocarbons therefrom. From the stripping zone, stripped catalyst may be passed into a regeneration zone wherein the stripped catalyst is regenerated by burning coke therefrom with an oxygen-containing gas, usually air. The resulting hot regenerated catalyst from the regeneration zone may be again brought into contact with additional hydrocarbon feedstock in the reaction zone, thus completing the catalyst cycle.

In fluidized catalytic cracking processes for conversion of normally liquid hydrocarbons, such as petroleum fractions, into lower boiling hydrocarbons, it is well known to employ catalysts comprising aluminosilicate zeolites or molecular sieves for conversion of hydrocarbon charge stocks into good yields of more desirable hydrocarbons, particularly naphtha fractions useful as motor fuels. Such catalysts conventionally comprise an amorphous matrix, such as silica-alumina or silica-magnesia complexes, containing a minor portion of one or more crystalline aluminosilicate zeolites or molecular sieves which have been ion exchanged with rare earth ions, magnesium ions, hydrogen ions, ammonium ions and/or other divalent and polyvalent ions for reduction of the sodium content of said molecular sieves to not more than one weight percent, and preferably less.

These cracking catalysts, hereinafter referred to as "zeolite catalysts", are well known and commercially available. The activity and selectivity of such zeolite catalysts for conversion of hydrocarbon charge stocks into useful cracked hydrocarbon products, particularly naphtha, are particularly affected by residual carbon remaining on regenerated catalyst in the form of "coke", i.e., a complex of carbon and high molecular weight hydrocarbons. In order to obtain the full utility and benefit of the activity and selectivity of such zeolite catalysts, coke or carbon on the regenerated catalyst is maintained below about 0.2 weight percent, and preferably of the order of 0.07 weight percent or less.

The present invention provides an improved process for regeneration of a spent coke contaminated cracking catalyst from a fluidized catalytic cracking reaction zone by burning coke from said spent catalyst with a regeneration gas, suitably air, containing uncombined or molecular oxygen, in a regeneration vessel to produce a flue gas comprising oxides of carbon, and regenerated catalyst containing 0.01 to 0.1 weight percent residual carbon. In a preferred embodiment, the flue gas comprises not more than 500 parts per million by weight (wppm) carbon monoxide.

In a preferred form of this invention, there is provided an improved method and apparatus for regenerating a zeolite cracking catalyst in which the contact between the oxygen-containing regeneration gas and the coke contaminated catalyst undergoing regeneration takes place in two stages comprising a dense phase fluidized bed stage followed by a dispersed phase catalyst stage as more fully defined and described hereinafter.

In accordance with the method of the present invention, a fluidized catalyst regeneration process is provided which permits control of regeneration temperature in a first regeneration zone wherein spent catalyst from a cracking reactor is first contacted with oxygen-containing regeneration gas, hereinafter referred to as primary regeneration gas or primary regeneration air. This control is accomplished in the process and apparatus of the present invention by regenerating spent catalyst in a novel combination of regeneration zones, which comprises a first dense phase fluidized bed catalyst regeneration zone, a dispersed phase riser regeneration zone, and a dense phase second catalyst bed separation zone constructed and arranged to provide maximum flexibility of temperature control of the exothermic regeneration reactions.

It is already known from U.S. Pat. No. 4,035,284 to carry out regeneration of spent catalyst in a dense fluid catalyst bed superimposed by a dispersed catalyst phase riser type regenerator at a temperature in the range of 1175° to 1350° F. The method and apparatus of this invention represents an improvement over such prior art and provides both a simplified apparatus and simplified method of circulating catalyst within the regeneration system as a means of regulating temperature in the first regeneration zone. Fluidization and control of flow of catalyst in the regenerator of this invention is accomplished by means of the oxygen-containing regeneration gas and resulting flue gases without the need for supplemental fluidizing gases.

The method and apparatus of this invention provides extreme flexibility with respect to catalyst regeneration operations, as will be apparent from a detailed description of a preferred embodiment of the process and apparatus of this invention as described hereinafter.

The FIGURE is a diagrammatic representation of a preferred form of apparatus forming a part of the present invention and suitable for carrying out the process of this invention.

Coke contaminated catalyst from a fluid catalytic cracking unit (FCCU) reactor and stripper (not illustrated in the drawing) is introduced through line 3 downwardly into a first regeneration zone 5 in a spherical or cylindrical vessel wherein catalyst is contacted with primary regeneration air introduced through line 6 to air distributor ring 7 in an amount sufficient to burn 80 to 90 percent of the coke from the catalyst and at a rate sufficient to fluidize the mass of catalyst particles in regeneration zone 5 and provide a fluidizing gas velocity in the range of 3 to 5 feet per second. At these high velocities, the catalyst density in regeneration zone 5 is of the order of 20 to 30 pounds per cubic foot.

Coke-contaminated spent catalyst is contacted, at catalyst regeneration conditions, for a residence time of about 10 seconds to about 1 minute, with a primary regeneration gas, e.g., air, introduced into said first regeneration zone 5 through line 6 to distributor ring 7 and discharged through a plurality of nozzles 8 at a velocity in the range of about 60 to 175 ft/sec effecting radial distribution of air and thorough mixing of spent catalyst and primary regeneration gas within first regeneration zone 5, and initiating burning of coke from the spent catalyst.

From the top of first regeneration zone 5, partially regenerated catalyst and gaseous products of the first regeneration zone comprising nitrogen, carbon dioxide and carbon monoxide, enter a riser transport regeneration zone 9, forming a suspension of catalyst particles in the upflowing gaseous product stream. A secondary stream of fresh regeneration gas sufficient in amount to provide an excess of oxygen over the stoichometric amount required for burning the residual coke contained on the spent catalyst and for burning carbon monoxide in the gaseous products of zone 5 to carbon dioxide is introduced into the lower part of riser regeneration zone 9 through line 12. Completion of the catalyst regeneration by burning substantially all the coke from said catalyst and substantially complete conversion of carbon monoxide to carbon dioxide occurs in riser reactor 9.

The superficial gas velocity in the upper dense phase fluidized bed of regenerated catalyst in vessel 13 is preferably within the range of about 2.5 to 4 feet per second with a catalyst bed density of the order of 20 to 30 pounds per cubic foot.

The total quantity of regeneration air introduced as primary regeneration gas through line 6 into the lower dense phase fluidized bed regeneration zone 5 and that introduced as secondary regeneration gas into the riser regeneration zone 9 through line 12 supplies an amount of oxygen sufficient to provide an excess of oxygen in the regeneration system and in the flue gas discharged from the system as hereinafter described. In normal operation a substantially constant amount of excess air is supplied to the regeneration system.

Flue gases and entrained catalyst from riser regeneration zone 9 are discharged into the lower part of a dense phase fluidized bed of regenerated catalyst in a second spherical or cylindrical vessel 13 through a discharge head 14 provided with a plurality of discharge slots 16 at the upper end of the riser reactor conduit 9. The dispersion or suspension of catalyst in flue gases is discharged from the riser conduit 9 through discharge slots 16 into the enlarged vessel 13 wherein there is a substantial reduction in the velocity of the gases permitting the catalyst to separate from the flue gases. Catalyst separated from the gases forms a dense phase fluidized bed 17 having a well defined upper level 18. In this regeneration system, coke introduced into the regenerator with the spent catalyst is ultimately substantially completely consumed to carbon dioxide, part of the oxidation taking place in the primary regeneration zone 5 and part occurring in the riser regeneration zone 9 and in the upper dense phase fluidized bed of regenerated catalyst contained in vessel 13.

Flue gases, comprising nitrogen, carbon dioxide and steam, and containing from about 1 to 10 volume percent oxygen, preferably about 1 to 3 volume percent oxygen and less than about 200 ppm carbon monoxide, are passed through cyclone separator 21 wherein finely divided entrained solid particles are separated from the gas stream and returned by dipleg 22 to the dense phase catalyst bed in vessel 13. The cyclone separator 21, although represented as a single unit, may comprise an assembly of cyclone separators arranged in parallel and in series to effect substantially complete separation of entrained solids from the flue gas. The effluent flue gas from cyclone separator 21 passes through line 23 into plenum chamber 24 from which it is discharged through flue gas line 25 to vent facilities, not illustrated.

Regenerated catalyst at a temperature in the range of 1250° to 1450° F. and containing 0.01 to 0.1 weight percent residual carbon in the upper dense phase fluidized bed in vessel 13 is withdrawn from the lower part of vessel 13 through standpipe 28 as needed to supply the hot regenerated catalyst to the reaction zone, not illustrated. Hot regenerated catalyst from the upper dense phase bed in vessel 13 is also supplied to the lower dense phase bed of catalyst in vessel 5 by way of standpipes 30. Hot regenerated catalyst from standpipe 30 is mixed in vessel 5 with spent catalyst from standpipe 3 and with catalyst undergoing regeneration in the lower dense phase fluidized bed at a controlled temperature preferably in the range of 1150° to 1400° F.

The recirculation rate of hot regenerated catalyst from vessel 13 to vessel 5 is determined by the size and number of standpipes 30, the difference in elevation between the upper regenerator vessel 13 and lower vessel 5, and the amount of regeneration air supplied to riser 9. The total amount of air supplied to the regeneration system is determined by the overall coke burning requirements for regeneration of the catalyst and the amount of excess oxygen maintained in the flue gas. The rate of recirculation of regenerated catalyst from vessel 13 to vessel 5 may be controlled by controlling the air split between the lower dense phase bed 5 and the riser 9. Hot regenerated catalyst circulates between the upper and lower zones because of the density difference between the catalyst in the standpipes 30, of the order of 25 to 35 $lb/ft^3$, and the catalyst suspension in the riser regeneration zone of the order of about 3 to 5 $lb/ft^3$. Increasing the air to the lower zone while decreasing the air to the riser decreases the catalyst density in the lower dense phase bed and causes the catalyst recirculation rate to increase due to the decreased catalyst head exerted by the lower dense bed plus riser. Lowering the air to the lower dense phase bed and increasing the air to the riser has the opposite effect of decreasing the catalyst recirculation rate. In this manner the temperature of the lower dense phase bed can be controlled without the need for expensive control valves in standpipes 30.

Under normal operating conditions wherein a substantially constant amount of excess air is supplied to the catalyst regeneration system, the temperature in the first dense phase bed regeneration zone (the lower zone) may be controlled by detecting the temperature of the fluidized bed of catalyst in the first regeneration zone, increasing the amount of air supplied to the riser regeneration zone and correspondingly decreasing the amount of air supplied to the first dense bed regeneration zone when the temperature in the first regeneration zone increases above a predetermined level and decreasing the amount of air supplied to the riser regenerator and correspondingly increasing the amount supplied to the first regeneration zone when the temperature in the first regeneration zone decreases.

Control of temperature in the first regeneration zone is an important part of the process of this invention. If the temperature in the first dense phase regeneration zone is too low, an excessive holding time is required in either the first regeneration zone or in the dilute phase regeneration zone, or both. If the required catalyst holdup is greater than the catalyst holding capacity of these two catalyst regeneration zones, combustion of carbon monoxide will be incomplete. If the temperature in the first regeneration zone is too high, the catalyst recirculation rate through the standpipes is excessive resulting in an excessive rate of wear on the equipment and increased catalyst attrition.

It will be evident from the foregoing detailed description that the present invention provides a simplified method of and apparatus for regenerating a hydrocarbon conversion catalyst by burning coke therefrom with air under controlled regeneration temperature conditions whereby the need for catalyst flow control valves and supplemental fluidizing gas are obviated.

We claim:

1. In a fluidized catalytic hydrocarbon conversion process wherein spent catalyst from said hydrocarbon conversion reaction is stripped of volatile hydrocarbons prior to regeneration and stripped catalyst is regenerated by burning coke therefrom with an oxygen-containing gas, the improvement which comprises passing stripped catalyst to a first catalyst regeneration zone of a catalyst regeneration system comprising multiple regeneration zones, maintaining a dense phase fluidized bed of catalyst in said first regeneration zone by the introduction of primary regeneration air into the lower portion of said zone at a rate sufficient to cause fluidization of said catalyst particles and partial regeneration of said catalyst with the production of gaseous reaction products comprising carbon monoxide, passing partially regenerated catalyst particles entrained in said gaseous reaction products from said first dense phase fluidized bed regeneration zone into a superposed disperse phase entrained catalyst riser regeneration zone, supplying secondary regeneration air to said riser regeneration zone in an amount sufficient to provide an excess of oxygen over that required for complete combustion of carbon monoxide and residual coke from said catalyst to carbon dioxide, discharging catalyst and flue gases resulting from the burning of coke from spent catalyst from the riser regeneration zone into the lower portion of a superposed second dense phase fluidized bed regeneration zone, maintaining a dense phase fluidized bed of catalyst in said second regeneration zone with fluidization solely by flue gases from said riser regeneration zone, separating flue gases from regenerated catalyst in said second regeneration zone, discharging resulting flue gases containing 1 to 3 mole percent oxygen and less than 500 ppm carbon monoxide from second regeneration zone, withdrawing regenerated catalyst containing 0.01 to 0.1 weight percent carbon and at a temperature in a range of 1250° to 1450° F. from said second dense phase regeneration zone as regenerated catalyst for said reaction zone, and recirculating a further separate portion of said regenerated catalyst from said second dense phase fluidized bed catalyst regeneration zone to said first dense phase fluidized bed catalyst regeneration zone wherein the rate or recirculation of regenerated catalyst from said second dense phase bed to said first dense phase bed regeneration zone is governed solely by the relative rates of introduction of primary and secondary regeneration air to said first regeneration zone and to said riser regeneration zone.

2. A process according to claim 1 wherein a substantially constant amount of excess air is supplied to said catalyst regeneration system and comprising the steps of detecting the temperature of said fluidized bed of catalyst in said first regeneration zone, increasing the amount of air supplied to said riser regeneration zone and correspondingly decreasing the amount of air supplied to said first fluidized bed regeneration zone when the temperature in said first regeneration zone increases above a predetermined level in the range of 1150° to 1400° F. and decreasing the amount of air supplied to said riser regeneration zone and correspondingly increasing the amount of air supplied to said first regeneration zone when the temperature in said first regeneration zone decreases below said predetermined level.

* * * * *